US007717017B2

(12) United States Patent
McBride et al.

(10) Patent No.: US 7,717,017 B2
(45) Date of Patent: May 18, 2010

(54) HAND TOOL AND METHOD OF USING SAME

(76) Inventors: Mark Tabin McBride, 837 San Luis Rey Ave., Coronado, CA (US) 92118; Dyson Lister Hamner, 13650 Orchard Gate Rd., Poway, CA (US) 92064; Joseph John Jankiewicz, 555 Ocean Blvd., Coronado, CA (US) 92118

( * ) Notice: Subject to any disclaimer, the term of this patent is extended or adjusted under 35 U.S.C. 154(b) by 125 days.

(21) Appl. No.: 12/137,482

(22) Filed: Jun. 11, 2008

(65) Prior Publication Data

US 2009/0308211 A1 Dec. 17, 2009

(51) Int. Cl.
*B25B 7/12* (2006.01)

(52) U.S. Cl. ..... 81/342; 81/351; 81/423; 30/252; 30/260; 30/177; 30/193

(58) Field of Classification Search ..... 81/342, 81/346–348, 350, 351, 362, 386, 387, 421–424; 30/177, 181, 183, 184, 186, 189–193, 252, 30/260, 28, 29

See application file for complete search history.

(56) References Cited

U.S. PATENT DOCUMENTS

| | | | | |
|---|---|---|---|---|
| 805,651 | A | 11/1905 | Lang | |
| 1,874,616 | A | 8/1932 | Porter | |
| 1,959,587 | A * | 5/1934 | Lawson | 30/177 |
| 2,020,242 | A | 11/1935 | Geddes | |
| 2,109,147 | A * | 2/1938 | Grosso | 606/205 |
| 2,507,710 | A * | 5/1950 | Grosso | 606/205 |
| 3,742,957 | A * | 7/1973 | White | 606/208 |
| 4,176,449 | A | 12/1979 | Lee et al. | |
| 4,910,870 | A | 3/1990 | Chang | |
| 5,063,666 | A | 11/1991 | Tsay | |
| 5,105,543 | A | 4/1992 | Maarschalk et al. | |
| 5,579,062 | A | 11/1996 | Sondrol | |
| 6,971,179 | B2 | 12/2005 | Ebrick | |

* cited by examiner

*Primary Examiner*—D. S Meislin
(74) *Attorney, Agent, or Firm*—Jerry R. Potts

(57) ABSTRACT

A hand tool generally includes a tool mount that removably receives thereon a tool. The tool mount and tool cooperate to provide the hand tool with a variable angle of attack with an enhanced power ratio for accommodating aged, arthritic and otherwise handicapped people.

17 Claims, 4 Drawing Sheets

HAND TOOL AND METHOD OF USING SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

The present invention is related to hand tools and more particularly, is related to a hand tool having a variable angle of attack with an enhanced power ratio for accommodating aged, arthritic and otherwise handicapped people.

SUMMARY OF THE INVENTION

A hand tool generally includes an upper tool mount that removably receives thereon an upper tool to facilitate rotating the upper tool to an upper tool operating position so as to effect an upper tool operation on an object and a lower tool mount that removably receives thereon a lower tool to facilitate rotating the lower tool to a lower tool operating position so as to effect a lower tool operation on the object. The hand tool further includes an upper handle which is coupled to the upper tool mount which helps to facilitate pivotally lowering the upper tool from an open position to a closed position to initiate the upper tool operation and further helps to facilitate pivotally raising the upper tool from the closed position to the open position to end the upper tool operation and a lower handle coupled to the lower tool mount which helps to facilitate pivotally raising the lower tool from another open position to another closed position to initiate the lower tool operation and further helps to facilitate pivotally lowering the lower tool from the another closed position to the another open position to end the lower tool operation.

BRIEF DESCRIPTION OF DRAWINGS

Other aspects and advantages of the present invention will become apparent from the following detailed description, taken in conjunction with the accompanying drawings, illustrating by way of example the principles of the invention.

DETAILED DESCRIPTION OF PREFERRED EMBODIMENTS

Figure 1:
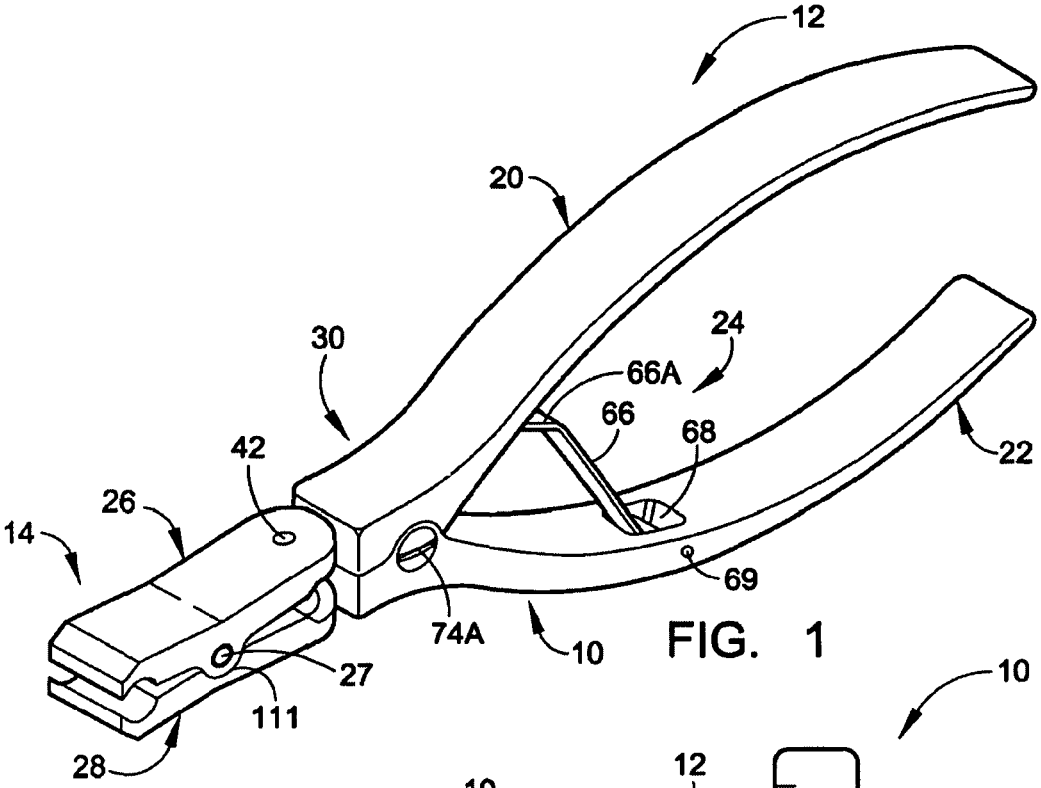
FIG. 1 is a pictorial view illustrating a hand tool which is constructed in accordance with a preferred embodiment of the present invention.
Figure 2:
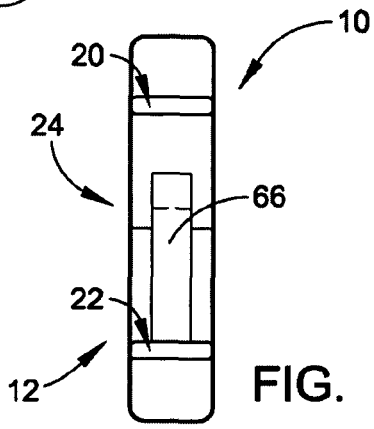
FIG. 2 is a rear plane view of the hand tool of FIG. 1.
Figure 3:
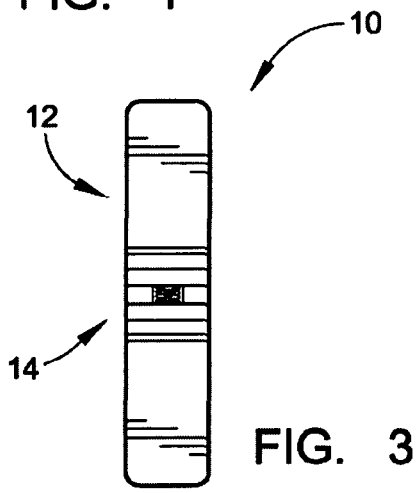
FIG. 3 is a front plane view of the hand tool of FIG. 1.
Figure 8:
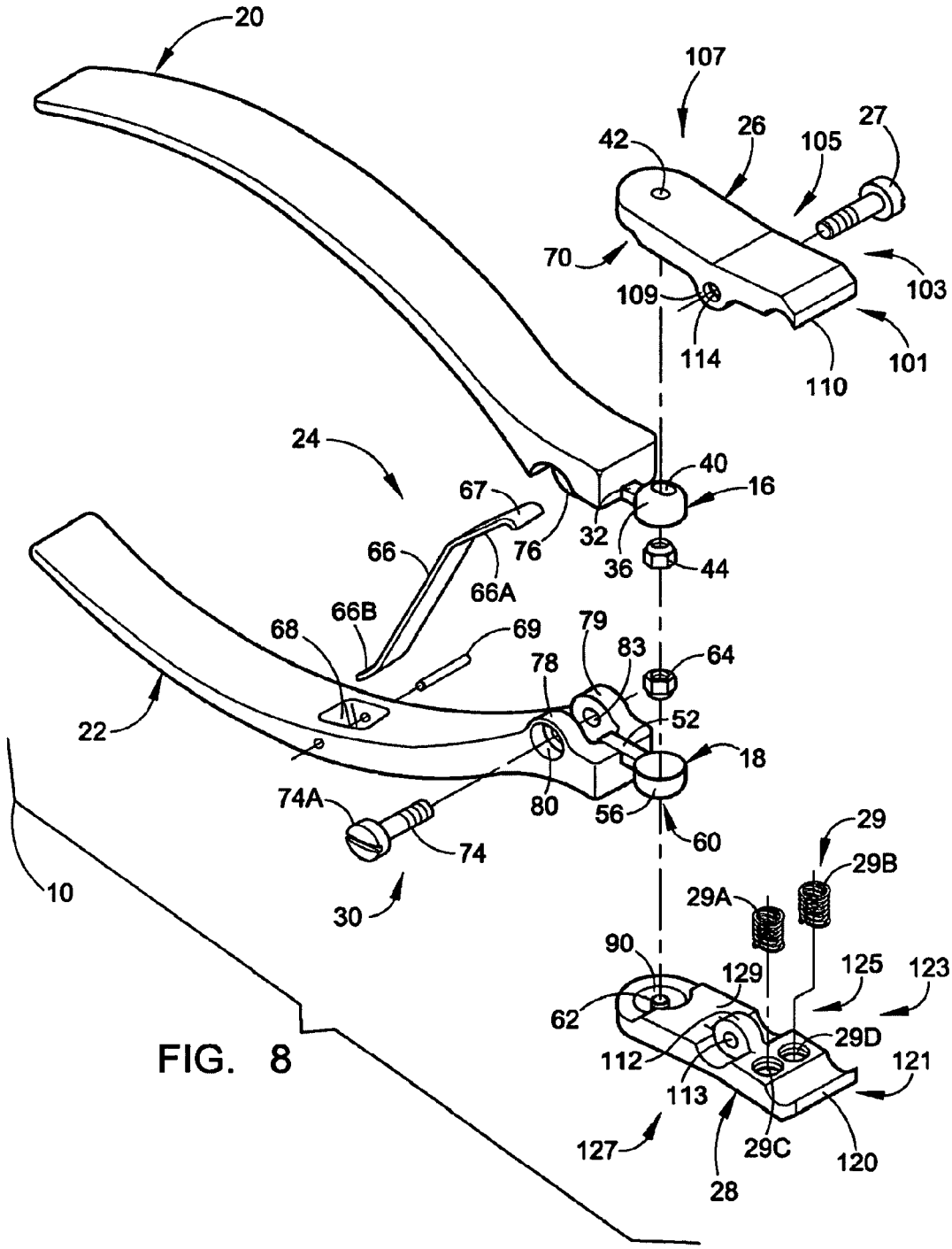
FIG. 8 is an exploded view of the hand tool of FIG. 1.

Referring now to the drawings and more specifically to FIGS. 1 and 8 thereof there is illustrated a hand tool 10 which is constructed in accordance with a preferred embodiment of the present invention. As will be explained hereinafter in greater detail, the hand tool 10 is provided with an interchangeable detachable tool which is ergonomically designed to provide a user with a substantial leverage advantage when cutting, clipping or gripping depending upon the type of tool employed. Moreover, the hand tool 10 is designed to provide a user with a variable angle of attack over a range of about one hundred and eighty degrees or extending at least ninety degrees to the right and at least ninety degrees to the left.

Considering now the hand tool 10 in greater detail with reference to FIGS. 1 and 8, the hand tool 10 generally includes a hand held tool mount indicated generally at 12 and a detachable or replaceable leverage tool 14. In the present preferred embodiment, the leverage tool 14 is illustrated as a nail clipper. However, it should be understood by those skilled in the art that the tool 14 may without limitation include a pincher, a plier, a gripper, a cutter and a chipper. Therefore there is no limitation relative to the type of leverage tool that may be mounted to the hand held tool mound 12.

Figure 5:
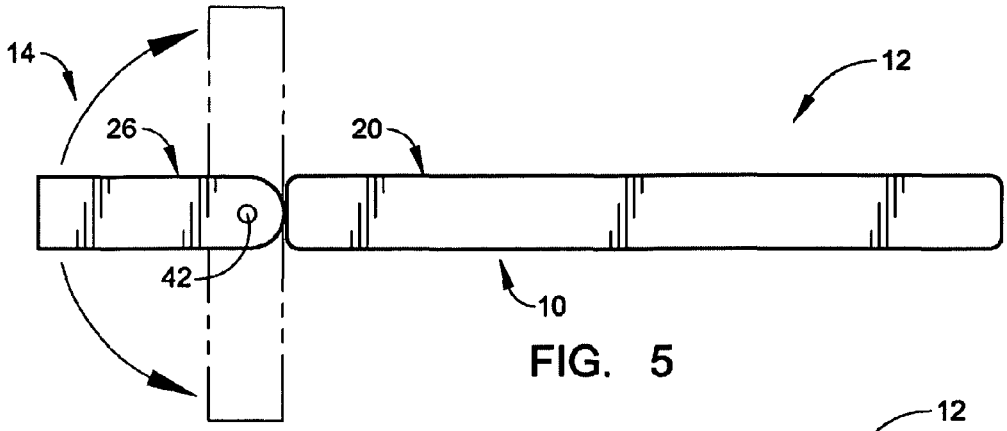
FIG. 5 is diagrammatic top plane view of the hand tool of FIG. 1, illustrating the extent of its rotational movement in the x-axis plane.
Figure 6:
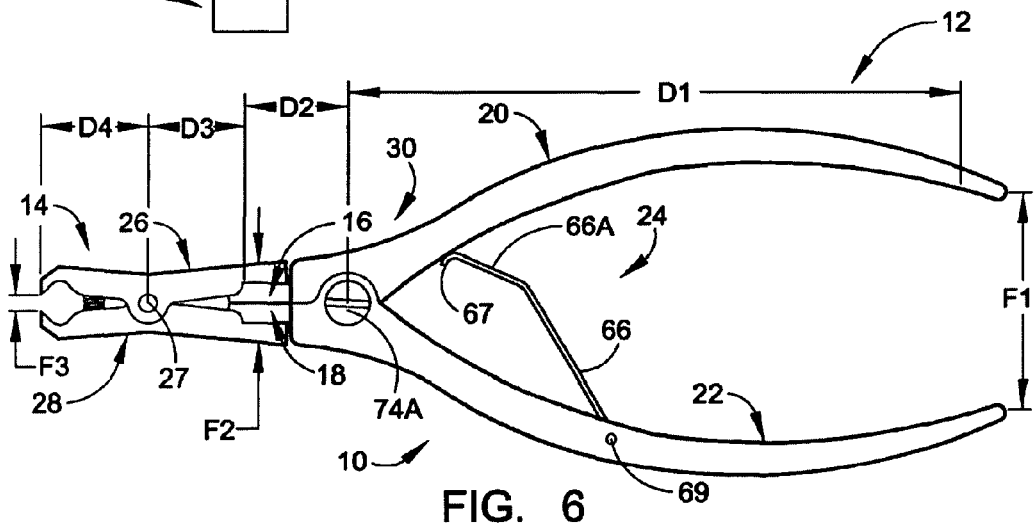
FIG. 6 is a right-side elevational view of the hand tool of FIG. 1, illustrating the tool in an open position.
Figure 7:
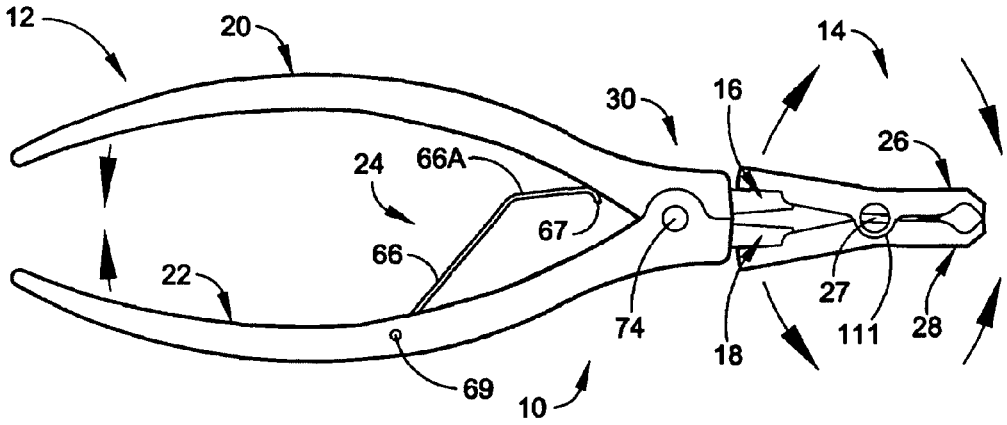
FIG. 7 is a left-side elevational view of the hand tool of FIG. 1, illustrating the tool in a closed position

As best seen in FIGS. 5-7, the replaceable tool 14 is adapted to be mounted to the tool mount 12 for both x-axis and y axis motions so as to provide a user (not shown) with a tool 14 having a variable angle of attack and which can be engaged in a tool operation with substantial leverage. In this manner the hand tool 10 allows ease of use by the aged and arthritic and otherwise handicapped whether they are left handed or right handed. More specifically the tool mount 12 enables the tool 14 to be rotated, by the user, in incremental steps in a horizontal or x-plane axis of rotation of between about 0 degrees to about 90 degrees either to the right or to the left as best seen in FIG. 5. The tool mount 14 also enables the tool 14 to open and close with a substantial power ratio of about 10:1 extending from the distal end of the tool mount 12 to the distal end of the tool 14 as best seen in FIGS. 6-7.

To provide the hand tool 10 with the advantages as noted-above, the hand held tool mount 12 generally includes an upper tool mount indicated generally at 16 and a lower tool mount indicated generally at 18. The upper tool mount 16 is coupled to an upper handle member 20 having a generally smooth arcuate shape to facilitate ease in gripping. In a like manner, the lower tool mount 18 is coupled to a lower handle member 22 also having a generally smooth arcuate shape. As will be explained hereinafter in greater detail, the upper handle member 20 and the lower handle member 22 are secured to together to allow a pivoting action in the y-axis plane as best seen in FIGS. 6-7. That is, the upper handle member 20 and the lower handle member 22 are adapted to pivot toward and away from one another as the user grips the handles within his or her hand and squeezes the respective handle members 20 and 22 together. In order to help facilitate providing the handle members 20 and 22 respectively with a return action when the squeezing force applied by the user is removed, the hand tool 10 is further provided with a handle compression spring 24 which is mounted between the upper handle member 20 and the lower handle member 22 as best seen in FIGS. 6-7. This pivoting action in the y-axis plane permits the leverage tool 14 to open and close to effect a user selected tool action or tool operation.

In the preferred embodiment the upper tool mount 16 is integrally coupled to the upper handle member 20, while the lower tool mount 18 is integrally coupled to lower handle member 22. It is contemplated however, that in modifying the preferred embodiment of the present invention, that the upper and lower tool mounts, 16 and 18 respectively, could also be secured to their respective handle members 20 and 22 by other conventional securing or mounting means such as by compression via a bolt and nut or by using high strength adhesives.

Considering now the replaceable leverage tool 14 in greater detail with reference to FIGS. 1 and 8, the tool 14 generally includes an upper tool member 26 and a lower tool member 28. The upper tool member 26 and the lower tool member 28 are mounted together for pivotal movement about a pivot axis defined by a mounting bolt 27. The upper tool member 26 and lower tool member are also spring loaded by tool spring means indicated generally at 29 as best seen in FIG. 8. The spring means 29 in the preferred embodiment generally includes a pair of spaced apart compression springs 29A and 29B respectively which are mounted in spring mount cutouts, such as the cutouts 29C and 29D disposed in the lower tool member 28. A similar set of cutouts (not shown) are disposed in the upper tool member 26. The compression springs 29A and 29B are disposed between the tool members to cause the upper tool member 26 and the lower tool member 28 to return to a non-object engaging position when an object engaging force applied to the tool 14 has been released. Although in the preferred embodiment a pair of compression springs has been utilized, it should be understood by those skilled in the art that other suitable spring means may be utilized, such as a single compression spring and other suitable compression spring means.

The upper tool member 26 is adapted to be mounted to the upper tool mount 16 to effect movement both in the x-axis plane and the y-axis plane. In a similar manner, the lower tool member 28 is adapted to be mounted to the lower tool mount 18 to effect movement both in the x-axis plane and the y-axis plane. As will be explained hereinafter in greater detail, the upper tool member 26 and the lower tool member 28 rotate simultaneously in the horizontal or x-axis plane to a user selected rotational angle for effecting a user selected tool operation. The user selected rotational angle is available in increments of between 1 degree and 90 degrees. A more preferred incremental angle is between 1 degree and 30 degrees, and the most preferred incremental angle is about 1 degree. Based on the foregoing it should be understood by those skilled in the art that the hand tool 10 provides a user with a tool having a variable angle of attack and with substantial leverage allowing ease of tool use by aged, arthritic and otherwise handicapped people whether they are left handed or right handed.

The method of effecting a tool operation on a user select object (not shown) includes the steps of providing the user with a hand held tool mount 12 and tool 14. The tool mount 12 in this case includes an upper tool mount 16 and a lower tool mount 18, while the tool 14 includes an upper tool member 26 and a lower tool member 28. Next, the user mounts simultaneously, the upper tool member 26 and the lower tool member 28 to their respective mounts or more particularly to the upper tool mount 16 and the lower tool mount 18 respectively. More specifically, the user squeezes the distal ends of the upper tool member 26 and the lower tool member 28 together causing the proximal ends of the upper tool member 26 and the lower tool member 28 to open away from one another a sufficient distance to allow the proximal ends to be aligned with respective ones of the upper tool mount 16 and the lower tool mount 18. In this regard, when alignment is achieved, the user releases the distal ends of the upper tool member 26 and the lower tool member 28 allowing the compression force of the return springs to hold the proximal ends of the upper tool member 26 and the lower tool member 28 respectively to the upper tool mount 16 and the lower tool mount 18 as best seen in FIG. 6. It should be understood by those skilled in the art, that the upper handle 20 and the lower handle 22 must not be squeezed together during this mount operation of mounting the leverage tool 14 to the tool mount 12.

Next the user rotates simultaneously the upper tool member 26 and the lower tool member 28 in a horizontal or x-axis plane a sufficient distance to reach a user selected rotational or attack angle. The attack angle in the preferred method of the present invention is between about 90 degrees to the right and about 90 degrees to the left in incremental steps in either direction of about 1 degree.

Next, the user pivots simultaneously the upper tool member 26 and the lower tool member 28 in a vertical or y-axis plane by pivoting or squeezing simultaneously the upper handle member 20 and the lower handle 22 over a sufficient distance to effect the tool operation selected by the user. The replaceable leverage tool 14 selected by the user is achieved by the user selecting from a group of tools consisting of a cutter, a gripper, a pliers and a chipper.

Considering now the power or leverage advantage provided by the hand tool 10 in greater detail with reference to FIG. 6, it can be seen that a user can apply a hand force F1 to the upper handle member 20 and the lower handle member 22 by squeezing the handle members 20 and 22 toward one another as best seen in FIG. 7. This force F1 is translated to the upper tool mount 16 and lower tool mount 18 as a translated force F2, where the force F2 is defined by equation 1 as follows:

$$F2=F1\ D1/D2 \qquad \text{Equation 1}$$

The translated force F2 is then translated to the upper tool member 26 and the lower tool member 28 respectively as another translated force F3, where the force F3 is defined by equation 2 as follows:

$$F3=F2\ D3/D4 \qquad \text{Equation 2}$$

As an illustrative example of the mechanical leverage achieved consider the follow:

Assume the applied force F1 equals 1 pound and the dimensions of D1-D4 are as follows:

D1=4.00 inches

D2=0.50 inches

D3=0.75 inches

D4=0.60 inches

Then $F2$=(1 pound)(4.00 inches)/(0.50 inches)=8.0 pounds $F3$=(8.0 pounds)(0.75 inches)/(0.60 inches)=10.0 pounds Thereby, it can be seen that at least a 10:1 leverage advantage is derived.

Considering now the compression spring 24 in greater detail with reference to FIG. 8, the compression spring 24 has a unitary construction that includes a central straight segment portion 66, which is disposed between an upper straight portion 66A and a lower rounded or curved end portion 66B. The upper straight portion 66A is disposed at a slight angle to the central segment portion 66 and terminates in a rounded or curved end portion 67.

Considering now the hand held tool mount 12 in still greater detail, the upper handle member 20 and the lower handle member 22 are elongate arcuate lever arms which are pivotally linked with each other via a linkage arrangement indicated generally at 30. More particularly, the upper handle member 20 and the lower handle member 22 are mounted to each other on an axis defined by a mount or linkage bolt 74 and are held apart from one another by the elongate compression or handle spring 24. The linkage bolt 74 facilitates holding the two handle members 20 and 22 pivotally together as will be explained hereinafter in greater detail.

In order to hold the handle members 20 and 22 apart, one end of the elongate compression spring 24 is mounted within a lower handle member cutout 68 and is secured within the cutout 68 by a mounting or spring pin indicated generally at 69. The cutout 68 is disposed at about an inner rearward surface area of the lower handle 22 in order to allow the spring 24 to be disposed at an inclined angle between the upper handle member 20 and the lower handle member 22 as best seen in FIGS. 6-7 of the drawings. The opposite end of the compression spring 24 which terminates in the rounded or curved end portion 67 permits the opposite or curved end portion of the compression spring 24 to rest in engagement with an inner surface area of the upper handle member 20. In short, the compression spring 24 is wedged between the upper handle member 20 and the lower handle member 22 to provide a return force when the two handle members are squeezed together as best seen in FIG. 7. This return force is a sufficient force to cause the two handle members 20 and 22 to move pivotally away from one another about the axis defined by the mounting bolt 74 when the handle members 20 and 22 are released by the user so they return to their non object engaging positions as best seen in FIG. 6.

Considering now the upper tool mount 16 in greater detail with reference to FIG. 8, the upper tool mount 16 as noted earlier is coupled to the upper handle member 20. In this regard, the upper tool mount 16 generally includes an elongate bar like extender 32 which is attached by one of its ends to a proximal end portion of the upper handle member 20. The opposite end of the extender 32 is attached to an upright hollow half sphere or upper ball member 36. The upper ball member 36 is adapted to be received within an upper tool socket 70 integrally formed within the upper tool member 26. The ball and socket arrangement between the upper ball member 36 and the upper tool socket 70 enables the upper tool member 26 to freely rotate in the x-axis plane relative to the upper ball member 36 as best seen in FIG. 5. In this regard, the extender 32 has a sufficient longitudinal dimension to space the upper tool member 26 from the upper handle member 20 so that there is frictional free rotational movement there between the upper tool member 26 and the upper handle member 20. Stated otherwise, the upper handle member 20 does not make physical contact with the upper tool member 26.

In order to facilitate mounting the upper tool member 26 onto the ball member 36, the ball member 36 has disposed at its upper pole area an aperture or hole 40. The hole 40 is dimensioned for receiving therethrough a threaded pin or bolt 42 (FIG. 5). As will be explained hereinafter in greater detail, the mounting pin 42 is threadably received within the upper tool member 26 and onto an upper mounting nut 44. The upper mounting nut 44 is dimensioned to be received within the hollow interior of ball member 36 for removably securing the upper tool member 26 to the upper tool mount 16. More particularly, the mounting pin 42 and mounting nut 44 cooperate together to secure the upper tool member 26 to the ball member 26 for rotational movement of the upper tool member 26 about the half sphere member 36 as best seen in FIG. 5. Although in the preferred embodiment of the present invention there is disclosed a mounting pin which is threadably received within the upper tool member 26, it is contemplated that the mounting pin 42 could also be integrally attached within upper tool socket 70 for mounting the upper tool member 26 to the upper tool mount 16.

Figure 4:
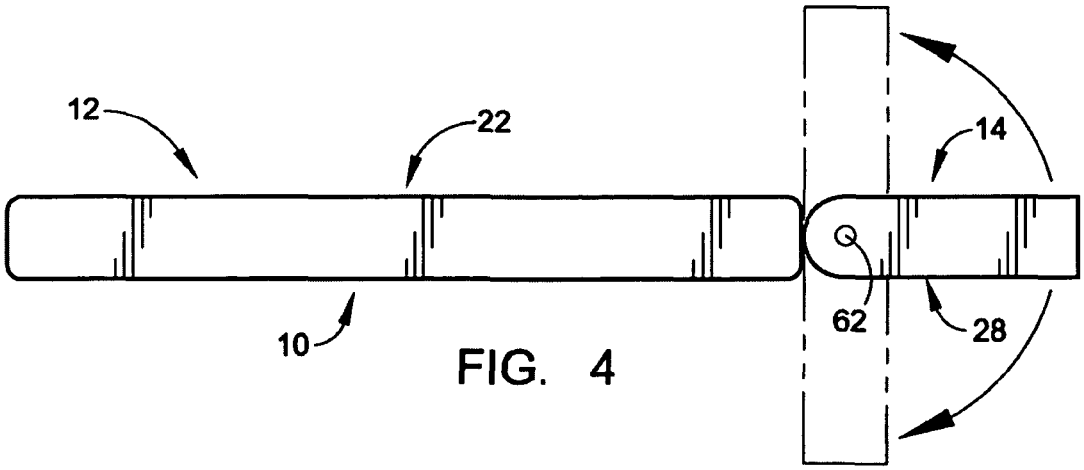
FIG. 4 is a bottom plane view of the hand tool of FIG. 1.

Considering now the lower tool mount 18 in greater detail with reference to FIG. 8, the lower tool mount 18 as noted earlier is coupled to the lower handle member 22. In this regard, the lower tool mount 18 generally includes an elongate bar like lower extender 52 which is attached or secured by one of its ends to a proximal end portion of the lower handle member 22. The opposite end of the extender 52 is secured or attached to an inverted hollow half sphere or lower ball member 56. The lower ball member 56 is adapted to be received within a lower tool socket 90 integrally formed within the lower tool member 28. The ball and socket arrangement between the lower ball member 56 and the lower tool socket 90 enables the lower tool member 28 to freely rotate in the x-axis plane relative to the lower ball member 56 as best seen in FIG. 4. In this regard, the extender 52 has a sufficient longitudinal dimension to space the lower tool member 28 from the lower handle member 22 so that there is frictional free rotational movement therebetween the lower tool member 28 and the lower handle member 22. Stated otherwise, the lower handle member 22 does not make physical contact with the lower tool member 28.

In order to facilitate mounting the lower tool member 28 onto the ball member 56, the ball member 56 has disposed at its lower pole area an aperture or hole 60. The hole 60 is dimensioned for receiving there through a threaded alignment or mounting pin or bolt 62. As will be explained hereinafter in greater detail, the mounting pin 62 is threadably received within the lower tool member 28 and onto a lower mounting nut 64. The lower mounting nut 64 is dimensioned to be received within the hollow interior of ball member 56 for removably securing the lower tool member 28 to the lower tool mount 18. More particularly, the mounting pin 62 and mounting nut 64 cooperate together to secure the lower tool member 28 to the ball member 56 for rotational movement of the lower tool member 28 about the half sphere member 56 as best seen in FIG. 4. Although in the preferred embodiment of the present invention there is disclosed a mounting pin which is threadably received within the lower tool member 28, it is contemplated that the mounting pin 62 could also be integrally attached within lower tool socket 90 for mounting the lower tool member 28 to the lower tool mount 18.

Considering now the linkage arrangement 30 in greater detail with reference to FIG. 8, the linkage arrangement 30 is partially disposed on the upper handle member 20 and partially disposed on the lower handle member 22. In this regard at about the proximal end of the upper handle member 20 and adjacent to the upper extender 32 is a circular like upper handle protuberance 76 having a centrally disposed hole which is dimensioned for receiving therein the linkage bolt 74. At about the proximal end of the lower handle member 22 and disposed adjacent to the lower extender 52 are a pair of spaced apart upstanding circular like protuberance members 78 and 79 respectively which form a saddle for receiving therein the upper handle protuberance 76. That is, the upper handle protuberance 76 is received between the two lower handle protuberance members 78 and 79 which helps to hold the upper handle protuberance 76 therebetween for pivotal movement. In order to help facilitate securing the protuberance members 76, 78 and 79 together for relative pivotal movement, the protuberance member 78 has a centrally disposed cutout 80. The cutout 80 is dimensioned for receiving therein a head portion 74A of the linkage bolt 74. Each respective protuberance member 78 and 79 has disposed therein a threaded hole or aperture such as the hole 83. The linkage bolt 74 is dimensioned to be threadably received within the protuberance holes, while the head 74A of the linkage bolt 74 is held within cutout 80. In this manner therefore, the bolt 74 and nut 84 cooperate with the upper handle member 20 and the lower handle member 22 to hold the two handle members together for pivotal movement abut their respective protuberance members.

Considering now the upper tool member 26 in still greater detail with reference to FIG. 8, the upper tool member 26 has a unitary construction and includes a front cutting portion 101, a first intermediate spring mounting portion 103, a second intermediate linking portion 105 and a rear mounting portion 107. At one end of the front cutting portion 101 there is disposed an elongate upper cutting edge 110 for engaging an object for object cutting purposes. The opposite end of the front cutting portion 101 is integrally connected to the spring mount portion 103.

The spring mount portion 103 is integrally connected between the front cutting portion 101 and the second intermediate linking portion 105, and generally includes the spring mount cutouts which are similar to spring mount cutouts 29C and 29D disposed in the lower tool member 28. These spring mount cutouts are slightly spaced apart from one another in the same manner as the spring mount cutouts 29C and 29D are spaced as best seen in FIG. 8.

The second intermediate linking portion 105 is integrally connected between the spring mount portion 103 and the rear mounting portion 107, and generally includes a stirrup in the form of two downwardly projecting generally circular protuberance members 109 and 111 respectively. The two protuberance members 109 and 111 are slight spaced apart from one another for receiving between them a linking protuberance 112 extending upwardly from the lower tool member 28 as will be explained hereinafter in greater detail. Each of the protuberance members 109, 111, and 112 have centrally disposed threaded holes or apertures, such as the apertures 113 and 114 which are dimensioned for receiving therein the linking bolt 27. In this manner, the linking bolt 27 is threadably received within the protuberance members 109, 111, and 112 holding or securing them together for relative pivotal movement about the linking axis defined by the bolt 27.

Considering now the lower tool member 28 in still greater detail with reference to FIG. 8, the lower tool member 28, like the upper tool member 26, has a unitary construction and includes a front cutting portion 121, a first intermediate spring mounting portion 123, a second intermediate linking portion 125 and a rear mounting portion 127. At one end of the front cutting portion 121 there is disposed an elongate upper cutting edge 120 for engaging an object for object cutting purposes. The opposite end of the front cutting portion is integrally connected to the spring mount portion 123.

The spring mount portion 123 is integrally connected between the front cutting portion 121 and the second intermediate linking portion 125, and generally includes the spring mount cutouts 29C and 29D. The spring mount cutouts 29C and 29D are slightly spaced apart from one another as best seen in FIG. 8.

The second intermediate linking portion 125 is integrally connected between the spring mount portion 123 and the rear mounting portion 127, and generally includes the upwardly projecting linking protuberance 112, which is dimensioned to be received in the stirrup formed in the upper tool member 26. In this manner, as noted earlier, the upper tool member 26 and the lower tool member 28 pivot about the axis defined by the bolt 27.

The rear mounting portion 127 includes a flat table portion 129 and a cutaway portion having the cutout 90 which is dimensioned for receiving therein the hollow half sphere member 36. The mounting pin 62 extends upwardly from the center of the cutout 90 in order to be received within the alignment hole 60 disposed within the half sphere member 56. In this manner, the half sphere member 56 is aligned within the cutout 90 for rotational movement about the alignment pin 27.

Considering now the rear mounting portion 107 of the upper tool member 26 in greater detail, it should be noted that the rear mounting portion 107 of the upper tool member 26 is substantially similar to the rear mounting portion 127 of the lower tool member 28. Therefore the rear mounting portion 107 of the upper tool member 26 will not be described hereinafter in greater detail.

Figure 9:
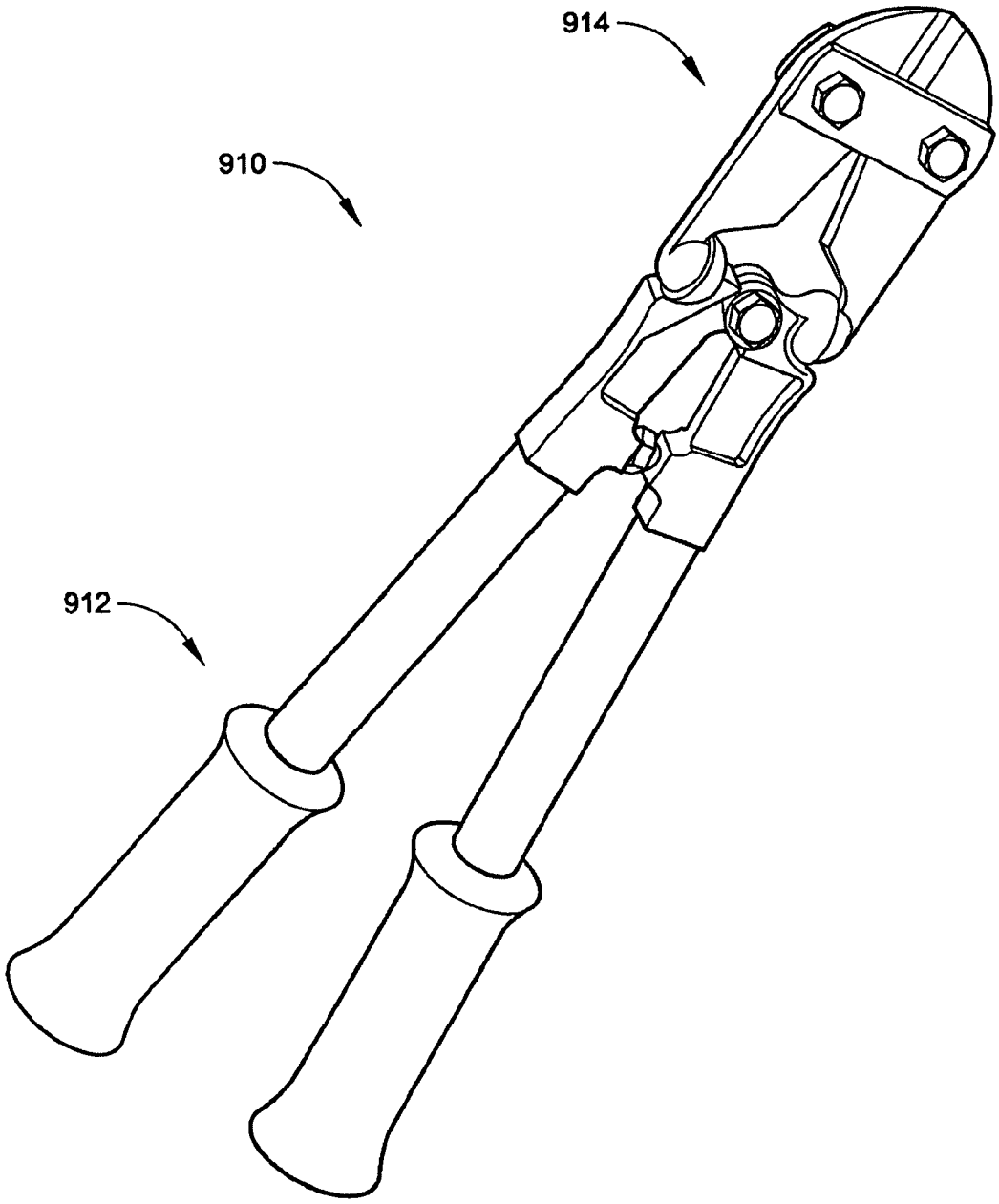
FIG. 9 is a pictorial view illustrating another hand tool which is constructed in accordance with another preferred embodiment of the present invention.

Referring now to the drawings and more particularly to FIG. 9, there is illustrated another hand tool 910 which is constructed in accordance with the present invention. The hand tool 910 is similar to the hand tool 10 and includes a hand held tool mount 912 and a replaceable leverage tool 914. From the forgoing, it should be understood by those skilled in the art, that various modification may be made to the invention as described without departing from the scope of the claims provided herein. Accordingly, it will be evident that there are additional embodiments and applications, which are not disclosed in the detailed description but which clearly fall within the scope of the present invention. The specification is, therefore, intended not to be limiting and the scope of the invention is to be limited only by the following claims.

We claim:

1. A hand tool, comprising:

an upright hollow half sphere integrally attached to an elongate upper handle extender;

an upper handle coupled to a proximal end of said upper handle extender;

an upper tool having an integrally formed upper tool socket, said upper tool socket adapted to be received on said upright hollow half sphere to enable said upper tool to freely rotate in an x-axis plane relative to said upright hollow half sphere;

an inverted hollow half sphere integrally attached to an elongate lower handle extender;

a lower handle coupled to a proximal end of said lower handle extender;

a lower tool having an integrally formed lower tool socket, said lower tool socket adapted to be received on said inverted hollow half sphere to enable said lower tool to freely rotate in an x-axis plane relative to said inverted hollow half sphere; and said upper tool and said lower tool being mounted together to effect their simultaneous rotational movement in a horizontal plane or to effect their simultaneous pivotal movement in a vertical plane.

2. The hand tool according to claim 1, wherein said upper tool and said lower tool are adapted to rotate in said horizontal plane between about 90 degrees to the right and about 90 degrees to the left.

3. The hand tool according to claim 2, wherein said upper tool and said lower tool are adapted to pivot in said vertical plane over a sufficient distance to achieve a desired tool operation on the object; and wherein said upper handle extender and said lower handle extender are adapted to pivot in said vertical plane over another sufficient distance to achieve said desired tool operation on the object.

4. The hand tool according to claim 3, wherein the ratio between said sufficient distance and said another sufficient distance is about a 10:1 ratio.

5. The hand tool according to claim 1, wherein said upper handle and said lower handle are spring loaded to facilitate effective rectilinear movement between said upper handle and said lower handle.

6. The hand tool according to claim 1, wherein said upper tool and said lower tool are spring loaded to facilitate effective rectilinear movement between said upper tool and said lower tool.

7. The hand tool according to claim 1, wherein said upper handle and said lower handle are spring loaded with first compression spring means to facilitate effective rectilinear movement between said upper handle and said lower handle; and wherein said upper tool and said lower tool are spring loaded with second compression spring means to facilitate effective rectilinear movement between said upper tool and said lower tool.

8. The hand tool according to claim 3, wherein said upper tool and said lower tool are adapted for pivotal movement regardless of the rotational orientation of said upper tool and said lower tool.

9. The hand tool according to claim 1, wherein said upper tool and said lower tool in combination define a gripper.

10. The hand tool according to claim 1, wherein said upper tool and said lower tool in combination define a cutter.

11. The hand tool according to claim 10, wherein said cutter is a nail clipper.

12. The hand tool according to claim 10, wherein said cutter is a bolt cutter.

13. A hand tool, comprising:

a spring loaded leverage tool having an object engaging distal end and a tool mount engaging proximal end; and a hand held tool mount to facilitate providing said leverage tool with x-axis motion relative to said tool mount for tool operation with a variable angle of attack on an object;

wherein said leverage tool includes an upper tool member and a lower tool member mounted pivotally together to provide the leverage tool with y-axis motion about its object engaging distal end and about its tool mount engaging proximal end;

wherein said leverage tool further includes at least one compression spring for holding said upper tool member and said lower tool member in an open non-object engaging position at about its object engaging distal end and for holding simultaneously said upper tool member and said lower tool member in a closed tool mount engaging position at about its tool mount engaging proximal end so said leverage tool remains secured to said handheld tool mount to achieve a desired tool operation on an object;

wherein said hand held tool mount includes:

an upper handle member and a lower handle member, said upper handle member and said lower handle member being mounted pivotally together to further facilitate providing a leverage advantage;

an elongate upper bar member coupled between said upper handle member and said upper tool member for spacing them a sufficient distance apart to still further facilitate providing a leverage advantage and to enable a substantial friction free rotational movement between said upper handle member and said upper tool member; and an elongate lower bar member coupled between said lower handle member and said lower tool member for spacing them a sufficient distance apart to still further facilitate providing a leverage advantage and to enable a substantial friction free rotational movement between said lower handle member and said lower tool member; and wherein said upper elongate bar member has a proximal end adapted to be coupled to said upper handle member and a distal end with an integrally formed upper tool mount;

wherein said upper tool mount is adapted to be received within an upper tool socket integrally formed within said upper tool member so that said upper tool member can freely rotate in an x-axis plane relative to said upper tool mount; and wherein said lower elongate bar member has a proximal end adapted to be coupled to said lower handle member and a distal end with an integrally formed lower tool mount;

wherein said lower tool mount is adapted to be received within a lower tool socket integrally formed within said lower tool member so that said lower tool member can freely rotate in an x-axis plane relative to said lower tool mount;

wherein said upper tool member and said lower tool member rotate simultaneously in a horizontal plane to a user selected rotational angle of between about 90 degrees to the right and about 90 degrees to the left; and wherein said upper tool member and said lower tool member pivot simultaneously in a vertical plane by simultaneously pivoting said upper handle member and said lower handle member over a sufficient distance for effecting a user selected tool operation.

14. The hand tool according to claim 13, wherein said upper tool mount is an upright hollow half sphere integrally attached to said upper elongate bar member.

15. The hand tool according to claim 13, wherein said lower tool mount is an inverted hollow half sphere integrally attached to said lower elongate bar member.

16. The hand tool according to claim 15, wherein said leverage advantage is about a 10:1 leverage advantage.

17. The hand tool according to claim 16, wherein said user selected rotational angle of between about 90 degrees to the right and about 90 degrees to the left may be made in incremental steps in either direction of about 1 degree.

* * * * *